US006540075B2

(12) United States Patent
King

(10) Patent No.: US 6,540,075 B2
(45) Date of Patent: Apr. 1, 2003

(54) BOBBIN STORING DEVICE

(76) Inventor: Feather King, 165 Reiten Dr., Ashland, OR (US) 97520

( * ) Notice: Subject to any disclaimer, the term of this patent is extended or adjusted under 35 U.S.C. 154(b) by 0 days.

(21) Appl. No.: 09/905,127

(22) Filed: Jul. 12, 2001

(65) Prior Publication Data

US 2003/0010662 A1 Jan. 16, 2003

(51) Int. Cl.[7] ..... B65D 85/67
(52) U.S. Cl. ..... 206/391; 206/303
(58) Field of Search ..... 206/303, 391, 206/563, 526

(56) References Cited

U.S. PATENT DOCUMENTS

D302,053 S * 7/1989 Bromberger ..... D28/20
4,933,998 A * 6/1990 Arnet ..... 4/521
5,327,799 A * 7/1994 Lin ..... 74/558
D395,629 S * 6/1998 Moore, Jr. ..... D12/177
5,873,540 A * 2/1999 Hardin ..... 206/406
D437,272 S * 2/2001 Lin ..... D12/177

* cited by examiner

*Primary Examiner*—David T. Fidei
(74) *Attorney, Agent, or Firm*—Thomas M. Freiburger

(57) ABSTRACT

A retaining device for sewing machine bobbins of various sizes is formed of flexible material, generally arcuate in cross section, defining a majority of a circle but open at an outer side. The retaining device thus defines a pair of opposed flanges or sidewalls which, upon placement of a bobbin in the holder, spread apart elastically, then return to a closed position capturing the two opposed circular discs of the bobbin within the holder. In a preferred embodiment the bobbin holder is generally toroidal in shape but for the open side, forming a continuous circular trough within which bobbins of various sizes can be placed.

3 Claims, 1 Drawing Sheet

BOBBIN STORING DEVICE

BACKGROUND AND SUMMARY OF THE INVENTION

The invention concerns bobbins for sewing machines, and more specifically relates to a bobbin storage device to retain bobbins of various sizes, for convenient retrieval.

Bobbins for use on sewing machines, particularly domestic sewing machines, generally are of metal or plastic, shaped as a spool with two circular disks held in spaced relationship by a cylindrical hub at the center of the bobbin. The bobbin is mounted on the sewing machine via a central, axial through hole defined by the cylinder of the hub. When bobbins of various sizes are stored for occasional use on the sewing machine, they are sometimes stored using this center through hole, to stack the bobbins together on a rod, or in a box having individual molded half-cylindrical recesses to hold bobbins, but not in a way to retain the bobbins.

The invention now described retains the bobbins in a different and more convenient manner. Instead of using the center hole for retention of a series of bobbins, the device of the invention grips the bobbins by their peripheral edges, in a flexible manner allowing easy placement and retrieval of bobbins, as well as accommodation of a range of different bobbin sizes.

Most broadly, the invention comprises a flexible trough which in cross section defines a generally arcuate shape of somewhat greater than a half circle, thus being open at an outer side. The trough may be formed of urethane or other flexible, rubbery material which when deflected tends to return to its original shape. The internal diameter or width of the flexible trough is such as to be capable of gripping the smallest-diameter bobbin of a series of bobbins, when the bobbin is inserted into the trough device by pushing it between the side walls and fully into the trough, in an orientation in which the bobbin and the trough are essentially coaxial. The flexible, rubbery material permits retention of a wide range of bobbin diameters.

A preferred form of the bobbin retention device is in an annular shape. The ring-shaped trough forms an approximate partial toroid, so that the bobbins can be positioned in an annular arrangement.

It is thus a main object of the invention to store bobbins, particularly bobbins used on a domestic sewing machine, in a convenient and readily retrievable manner, accommodating a range of bobbin sizes in a simple device. These and other objects, advantages and features of the invention will be apparent from the following description of a preferred embodiment, considered along with the drawings.

DESCRIPTION OF PREFERRED EMBODIMENTS

Figure 1:
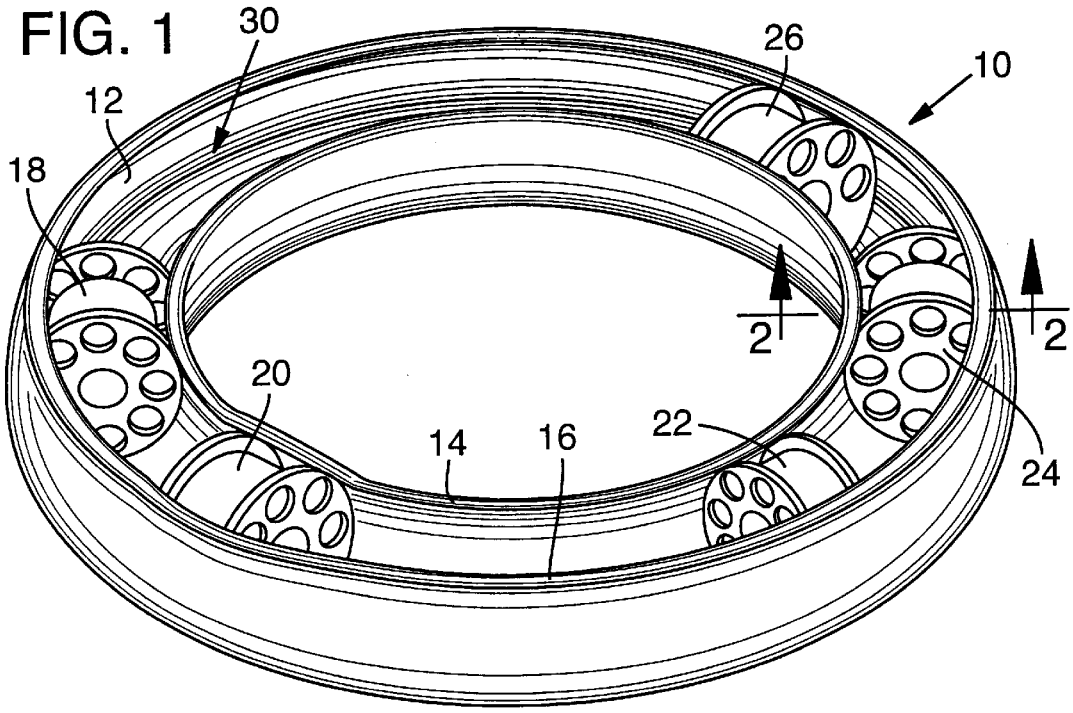
FIG. 1 is a perspective view showing a bobbin storage device with a series of bobbins retained in the device.
Figure 2:
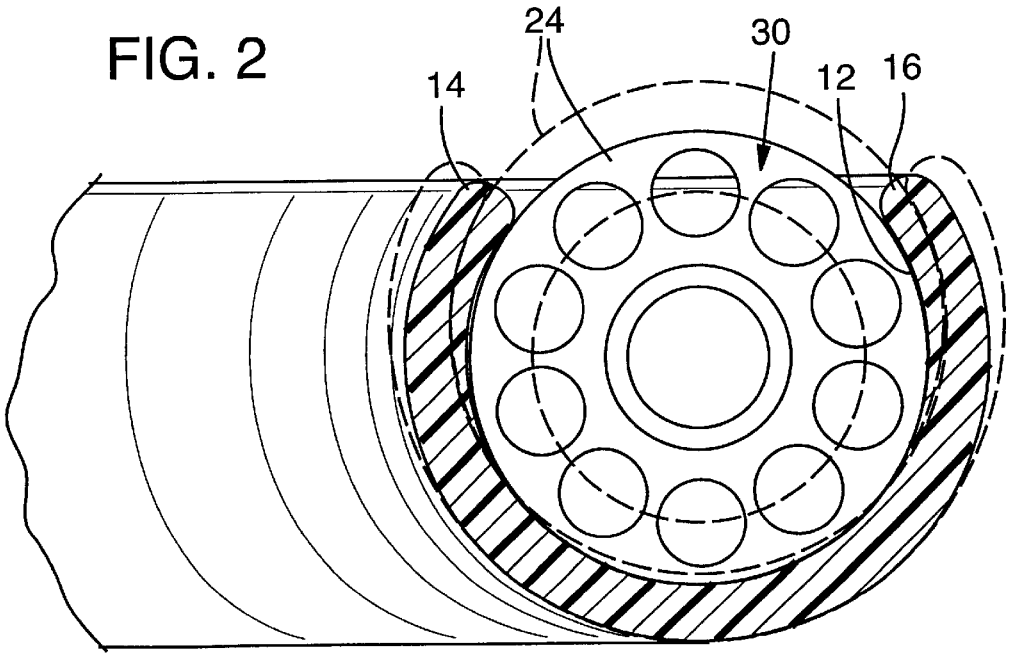
FIG. 2 is a sectional view through the bobbin holder trough, showing retention of a bobbin.

The bobbin retention device of the invention is shown at 10 in FIG. 1. It comprises a flexible, rubbery material such as thermoplastic elastomer, and this may be the material Dynaflex marketed by GLS Corp. The rubbery material is formed into a trough with a roughly arcuate interior 12 defining more than half a circle as viewed in cross section and shown in FIG. 2. The device thus comprises a trough with a pair of sidewalls 14 and 16. These side walls deform easily when a bobbin is pushed into the trough, then return to their original configuration as far a possible, as permitted by the diameter of the bobbin 18 as seen in FIG. 2.

FIG. 1 shows that bobbins 20, 22, 24, 26, etc. of various diameters can be retained within the trough 30 of the bobbin holder device. The rubbery material of the device tends strongly to return to its original, undeformed shape, so that even if a larger-diameter bobbin is positioned next to a minimum-diameter bobbin, the device will still locally put inward pressure on the bobbins sufficient to retain each bobbin in place.

One preferred form of the bobbin holder device is an annular configuration as shown in FIG. 1. The outer diameter of the entire ring may be about 5 inches, and the inside diameter of the arc (seen in cross section in FIG. 2) may be in the range of about ¾ inch to one inch. Such a configuration, if made of the material Dynaflex or a similar thermoplastic elastomer, can retain bobbins having diameters from about 13/16 to 15/16 inches. The device may be produced in other dimensions, as dictated by the sizes and number of bobbins to be retained.

The above described preferred embodiments are intended to illustrate the principles Qf the invention, but not to limit its scope. Other embodiments and variations to this preferred embodiment will be apparent to those skilled in the art and may be made without departing from the spirit and scope of the invention as defined in the following claims.

I claim:

1. A bobbin retaining device for storing sewing machine bobbins of the type comprising a pair of circular discs connected by a cylindrical hub, comprising, a flexible rubbery trough having an interior shaped approximately arcuately in cross section and defining more than half a circle, the trough being open at an outer side, the trough having contained therein a plurality of bobbins of different diameters with side walls of the trough engaged against the disks of the bobbins, the bobbins being oriented with their circumferences generally concentric with the arcuate cross section of the trough, and the side walls of the trough being deformed to accommodate the bobbins but exerting inward force tending to return to the undeformed shape of the trough.

2. The bobbin retention device of claim 1, wherein the trough is endless, formed in a generally annular configuration.

3. The bobbin holder of claim 1, wherein the flexible rubbery material of the trough comprises a thermoplastic elastomer.

* * * * *